US005980443A

United States Patent [19]

Kayser et al.

[11] Patent Number: 5,980,443

[45] Date of Patent: Nov. 9, 1999

[54] ENVELOPE BYPASS DEVICE FOR FOLDING MACHINE

[75] Inventors: David E. Kayser, Middlebury; Francesco Porco, Fairfield; Samuel W. Martin, Weston, all of Conn.

[73] Assignee: Pitney Bowes Inc., Stamford, Conn.

[21] Appl. No.: 08/996,710

[22] Filed: Dec. 23, 1997

[51] Int. Cl.[6] ..... B31F 1/00; B31F 7/00

[52] U.S. Cl. ..... 493/420

[58] Field of Search ..... 53/381.5, 381.6, 53/284.3, 569, 460; 493/419, 420, 245, 279, 917; 270/58.02, 58.04, 58.06

[56] References Cited

U.S. PATENT DOCUMENTS

| | | | |
|---|---|---|---|
| 4,897,145 | 1/1990 | Marzullo | 493/420 |
| 4,944,131 | 7/1990 | Gough | 493/420 |
| 5,045,043 | 9/1991 | Brown et al. | 493/245 |
| 5,054,757 | 10/1991 | Martin et al. | 270/45 |
| 5,176,614 | 1/1993 | Krasuski | 493/421 |
| 5,183,246 | 2/1993 | Edwards et al. | 270/45 |
| 5,196,083 | 3/1993 | Baker et al. | 493/420 |
| 5,263,708 | 11/1993 | Hacknauer | 493/420 |
| 5,388,388 | 2/1995 | Belec et al. | 53/460 |

*Primary Examiner*—Eugene L. Kim

*Attorney, Agent, or Firm*—Ronald Reichman; Melvin J. Scolnick

[57] ABSTRACT

A folding machine is adapted to receive customized printed sheets and envelopes from a printer and to fold the sheets preparatory to the sheets being inserted into an envelope, but to feed the envelopes through the folding machine directly to an envelope inserting machine without the envelopes being folded. The folding machine has a main path of travel extending therethrough, and a bypass gate mounted in the main path of travel to divert sheets from the main path of travel and directs them into a folding mechanism. The bypass gate is movable from a diverting position to a non-diverting position in response to a sensing device that distinguishes between an envelope and a sheet, so that the bypass gate moves from the diverting position to a non-diverting position to permit the envelope to bypass the folding mechanism and travel directly to the inserting machine.

5 Claims, 6 Drawing Sheets

ENVELOPE BYPASS DEVICE FOR FOLDING MACHINE

BACKGROUND OF THE INVENTION

The present invention relates generally to the field of sheet folding machines, and more particularly to a sheet folding machine in which envelopes can be fed into the folding machine along the same feed path as that for sheets, but will be diverted away from the buckle chutes and fed directly to an inserting machine.

Sheet folding machines have long been well known and have enjoyed great commercial success in a variety of document processing applications, particularly those associated with the preparation of mail in which one or a plurality of sheets are folded in a variety of configurations before being inserted into envelopes in an envelope inserting machine. Briefly, folding machines of this character comprise one or a pair of buckle chutes and a plurality of sets of feeding and folding rollers. In a typical arrangement, sheets are fed into the folding mechanism and directed into a first buckle chute by a first pair of feeding rollers until the lead edge of the sheet strikes a stop, after which the portion of the sheet adjacent to the entrance of the buckle chute buckles to form a new lead edge, which then passes through the next pair of feeding rollers which creases the new lead edge, thereby forming a first fold in the sheet. The new lead edge is then directed into a second buckle chute until it strikes a stop, which causes the portion of the sheet adjacent to the entrance of the second buckle chute to buckle and form still another new lead edge, and this new lead edge then passes through still another pair of feeding rollers which again creases the lead edge, thereby forming a second fold in the sheet. The tri-folded sheet is then fed through a discharge path from the folding machine.

Significant developments in recent years in high speed, automated document processing technology have resulted in various types of document processing systems and apparatus which utilize the above described functions of folding machines in combination with printing machines and envelope inserting machines for the purpose of simplifying the process of printing documents and envelopes at the same time, folding the documents and inserting designated documents into designated envelopes. For example, in one system developed by the assignee of this application, a form letter is to be sent to a large number of addressees, but each form letter is personalized by being addressed to an individual whose name and address is in a computer data base. A computer printer, preferably a laser printer in order to obtain optimum print quality, prints a letter with a name and address on a letter head, a large quantity of which is stored in a suitable feeder for the computer printer. Depending on the configuration of the document processing apparatus, either the same or another printer prints the same name and address on an envelope, a large quantity of which is stored in another suitable feeder for whichever printer prints on the envelopes. Both the letters and the envelopes are fed toward the folding machine, the letter being fed along one path which passes through the folding machine, the envelope being fed along another path which bypasses the folding machine and leads directly to the inserting machine. After folding, the letter is fed into the inserting machine and is inserted into the envelope, either by itself or with other insert material, depending on the configuration of the entire document processing apparatus.

Despite the fact that commercially available document processing apparatus for performing a process as just described has been well received, there are a number of problems inherent in the operation of the available apparatus which contribute to high purchase cost, mechanical complexity and limited operating speed, all of which impede the further commercial success of such apparatus. One of these problems is that if one printer is used for both letters and envelopes, the envelopes must be fed through the printer short edge first because most currently available laser printers are either incapable of printing along a wide enough range to print a letter on a letter head and also a return address on an envelope, the latter being well outside of the left margin of the letter being printed by the computer printer. On the other hand, if a wide enough printer is used for both printing tasks, it is very costly and therefor undesirable from a commercial standpoint. In the first situation, since the envelope must be fed into the inserting mechanism long edge first in order for the letter to be inserted, some type of envelope turning mechanism must be provided to turn the envelope through a 90° angle before the envelope can be fed into the inserting mechanism. And in both situations, it is necessary to have separate feed mechanisms and feed paths for the letter and the envelope since the letter must go through the folding machine, but the envelope must bypass the folding machine and proceed directly to the inserting machine. It should be apparent that both the turning mechanism and the separate feeding mechanisms add cost, complexity and limited speed of operation to the processing apparatus.

Alternatively, if two printers are used, one for the letter and another for the envelopes, and if they are both laser printers, a very substantially cost factor is added to the cost of the processing apparatus due to the relatively high cost of good quality, high speed laser printers. And the envelope turning device may still be required.

In a still further alternative, an ink jet printer is substituted for the second laser printer that prints the address and return address on the envelopes, thereby substantially reducing the cost of the second printer, since ink jet printers by and large are considerably less costly than laser printers, and the same quality of print as that desired for the letters is not necessary for the envelopes. Also, the necessity for a turning device is eliminated because the ink jet printer is printing only on the envelope, and it can be configured to print with the envelope traveling with the long edge first However, this introduces still another problem, which is that ink jet printers produce a wet document, thereby preventing the document from being handled in the area of the image until the ink is thoroughly dry in order to prevent the image from being smeared. In order to overcome this problem, it is necessary to provide some type of mechanism that will provide a drying station for the envelopes, typically in the form of a feeding and storage mechanism mounted adjacent the output end of the ink jet printer which will move a plurality of printed envelopes slowly through the drying station and then into the inserting mechanism. This technique, however, introduces two problems, one being the necessity of providing an additional mechanical mechanism, the cost of which offsets, to some extent, the savings realized from changing the second printer from laser to ink jet and eliminating the turning mechanism. The other is that the software control for printing the letters and the envelopes becomes more complicated because instead of simply printing the letters and envelopes in synchronism and feeding both to the inserting mechanism in succession, either a plurality of letters corresponding to the number of envelopes printed and stored in the drying mechanism must be printed and accumulated until the envelope for a designated letter reaches the inserting mechanism, or the letters must be printed out of synchronism with the envelopes, so that, for example, the letter for the first envelope is not printed until all of the envelopes normally stored in the drying mechanism have been printed and the first envelope printed reaches the inserting location.

Thus, it is seen that virtually regardless of the configuration of the document processing apparatus for the particular application under consideration, whether it involves a single printer, for which inexpensive technology is not readily available, or two printers using readily available technology, there are significant problems of one nature or another that prevent a document processing apparatus from being designed and marketed that would effectively take advantage of commercially available document processing components. There is, therefore, a need for a document processing apparatus in which a single laser printer can be utilized for printing both a letter and an envelope in synchronism, printing on the envelope with the long edge leading, feeding both the letter and the envelope, with the long edge leading, along the same feed path by the same feeding mechanism directly from the printer to the folding machine, and causing the envelope to bypass the folding mechanism of the folding machine and move directly therethrough to the inserting machine

BRIEF SUMMARY OF THE INVENTION

The present invention substantially obviates, if not entirely eliminates, the above problems and disadvantages of the type of document processing apparatus under consideration, and provides an effective solution to achieving such an apparatus which fulfills the needs just stated.

The present invention is an improvement in conventional folding machine design in which an envelope bypass mechanism can distinguish between a sheet on which a customized letter is printed and an envelope in which the letter is to be inserted, and which causes the envelope to bypass the buckle chutes of the folding machine and be directed along a main path of travel straight through the folding machine to the inserting machine, and also to cause sheets to be diverted out of the main path of travel and be directed into the buckle chutes for folding, after which it is fed out of the folding machine to the inserting machine and inserted into the envelope. In this manner, it becomes possible to print an envelope in synchronism with each letter for each addressee utilizing the same printer, thereby substantially eliminating all of the foregoing disadvantages and problems of the prior art techniques.

The envelope bypass mechanism of the present invention takes advantage of the fact that a typical #10 business envelope is longer than the width of a standard letter size sheet, with the result that the bypass mechanism can distinguish a sheet from an envelope by recognizing the edge portion of one end of the envelope that projects beyond the corresponding edge of the sheet. In one embodiment of the invention, this is accomplished by means of the bypass mechanism including a suitable detecting device which detects the presence of that portion of the envelope, and which then actuates the bypass mechanism to move from a diverting position to a non-diverting position to cause the envelope to bypass the buckle chutes of the folding mechanism and pass directly to the inserting machine. As soon as the envelope passes the bypass mechanism, it resets to the diverting position to cause a sheet to be fed into the buckle chutes. In another embodiment, the bypass mechanism is constructed such that an actuating element thereof is disposed in the path of the edge portion of the envelope that projects beyond the edge of the sheet, so that the edge portion of the envelope itself actuates the bypass device to move from the diverting position to the non-diverting position to allow the envelope to bypass the buckle chutes.

Thus, in its broader aspects, the invention is an improvement in a folding machine for folding sheets of paper preparatory to the sheets being inserted into envelopes in an envelope inserting machine, and for feeding envelopes through the folding machine to the envelope inserting machine, the envelopes having at least one longitudinal marginal portion which extends beyond the width of the sheets, the folding machine having first and second buckle chutes having entrance openings adjacent one another for receiving sheets to be folded, and first and second sets of feeding and folding rollers disposed adjacent the entrance openings of the buckle chutes for folding sheets directed into the buckle chutes. Within this environment, the invention is the improvement in the folding machine which comprises means defining a main path of travel for envelopes through the folding machine which bypasses the entrance openings into the buckle chutes, gate means mounted in the folding machine adjacent the entrance opening of the first buckle chute, and means mounting the gate means for movement between a first position in which the gate means diverts sheets from the main path of travel and into the first buckle chute for folding, and a second position in which the gate means permits envelopes to follow the main path of travel through the folding machine to the inserting machine. There is means responsive to an envelope arriving at a predetermined location in the folding machine for moving the gate means from the first position to the second position, and means responsive to the envelope passing the predetermined location in the folding machine for moving the gate means from the second position back to the first position. Thus, sheets entering the folding machine are diverted from the main path of travel and are folded by the buckle chutes and the feeding and folding rollers, and envelopes entering the folding machine are permitted to follow the main path of travel through the folding machine directly to the inserting machine and bypass the buckle chutes.

In some of its more limited aspects, the means for moving the gate means from the first position to the second position comprises means disposed in the main path of travel upstream from the entrance openings into the buckle chutes and in position to be engaged by the marginal portion of the envelopes. In one embodiment of the invention, this means comprises a solenoid operatively connected to the gate means for moving the gate means from the first position to the second position when the solenoid is energized, and the means disposed in the main path of travel in position to be engaged by the marginal portion of the envelope comprises switch means adapted when engaged by the marginal portion of the envelope to energize the solenoid. In another embodiment of the invention, the means for moving the gate means from the first position to the second position comprises actuating means operatively connected to the gate means for moving the gate means and disposed in the main path of travel in position to be engaged by the marginal portion of the envelope from the first position, this means comprising an actuating arm operatively connected to the gate means and disposed in the main path of travel beyond the lateral margin of the sheets but within the longitudinal margins of the envelopes so as to be engaged by the marginal portion of the envelopes as they move through the main path of travel.

Having briefly described the general nature of the present invention, it is a principal object thereof to provide an improvement to a sheet folding machine in which both sheets and envelopes are fed from a printing machine into the folding machine, the sheets being folded but the envelopes traveling through the folding machine directly to an envelope inserting machine.

Another object of the present invention is to provide an improvement to a sheet folding machine in which the folding machine is normally operable to direct incoming sheets into a folding mechanism, but which is capable of distinguishing between a sheet and an envelope and is automatically rendered operable upon recognizing the presence of an envelope to feed the envelope through the folding machine to the inserting machine so as to bypass the folding mechanism.

Still another object of the present invention is to provide an improvement to a sheet folding machine in which a sensing mechanism actuated by a marginal portion of an envelope that projects beyond the lateral edge of a sheet is effective to determine that an envelope is being fed into the folding machine and to cause the envelope to bypass the folding mechanism and travel through the folding machine directly to an inserting machine.

These and other objects and advantages of the present invention will be more apparent from an understanding of the following detailed description of presently preferred modes of carrying out the principles of the present invention, when considered in conjunction with the accompanying drawings.

DETAILED DESCRIPTION OF THE INVENTION

Figure 1:
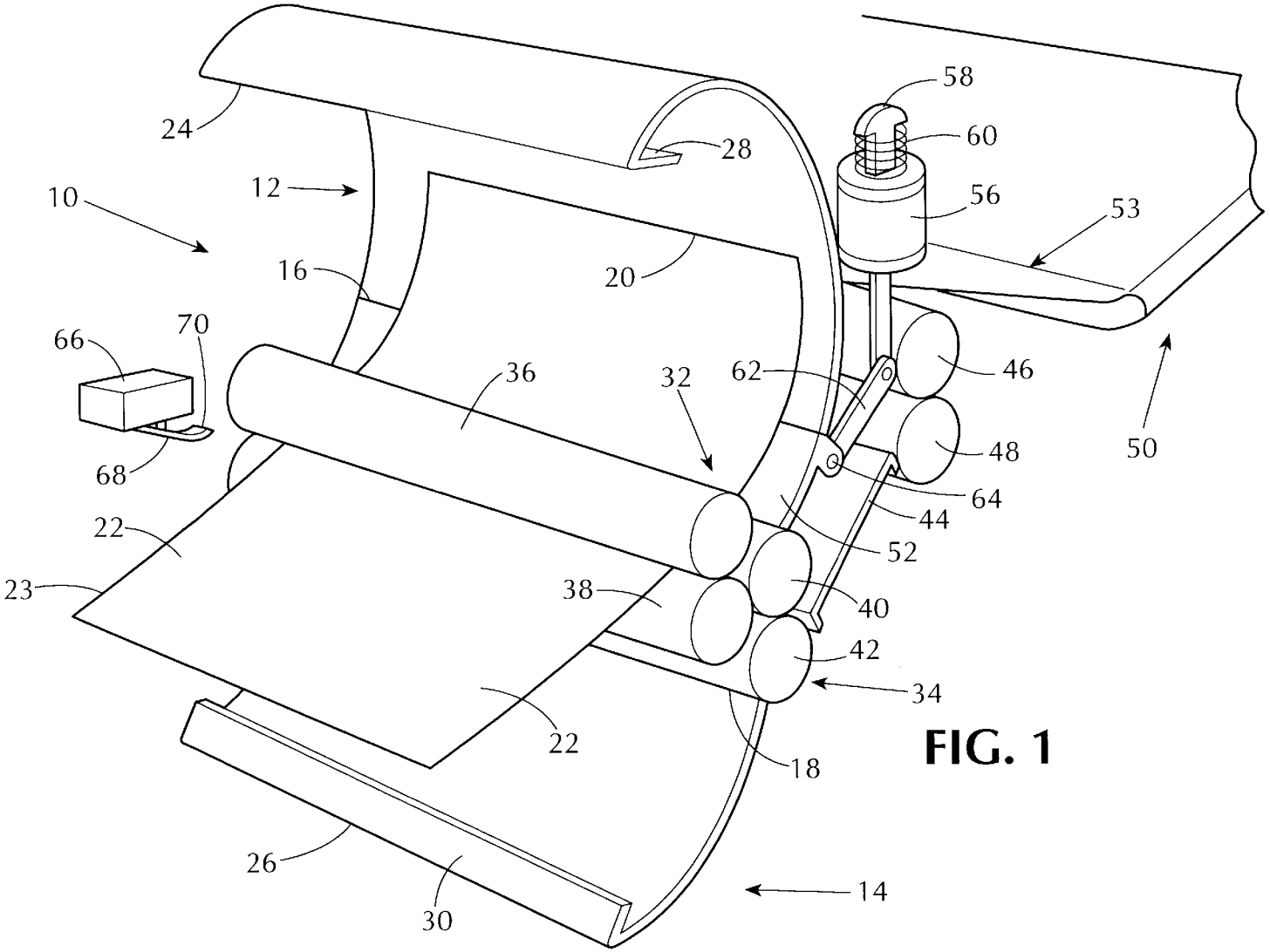
FIG. 1 is a perspective diagrammatic view of a folding machine embodying the principles of one embodiment of the present invention, and showing a sheet being folded in the folding machine.
Figure 2:
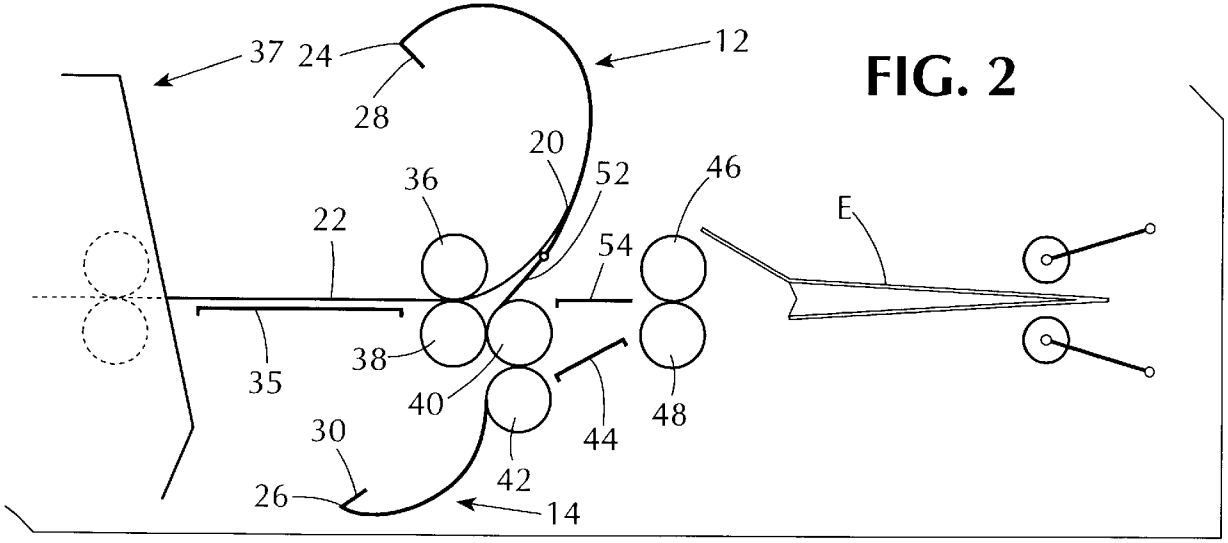
FIG. 2 is a diagrammatic side view of the folding machine shown in FIG. 1 showing a sheet entering the folding machine with the envelope bypass gate in the diverting position to cause the sheet to be folded within the folding machine.
Figure 3:
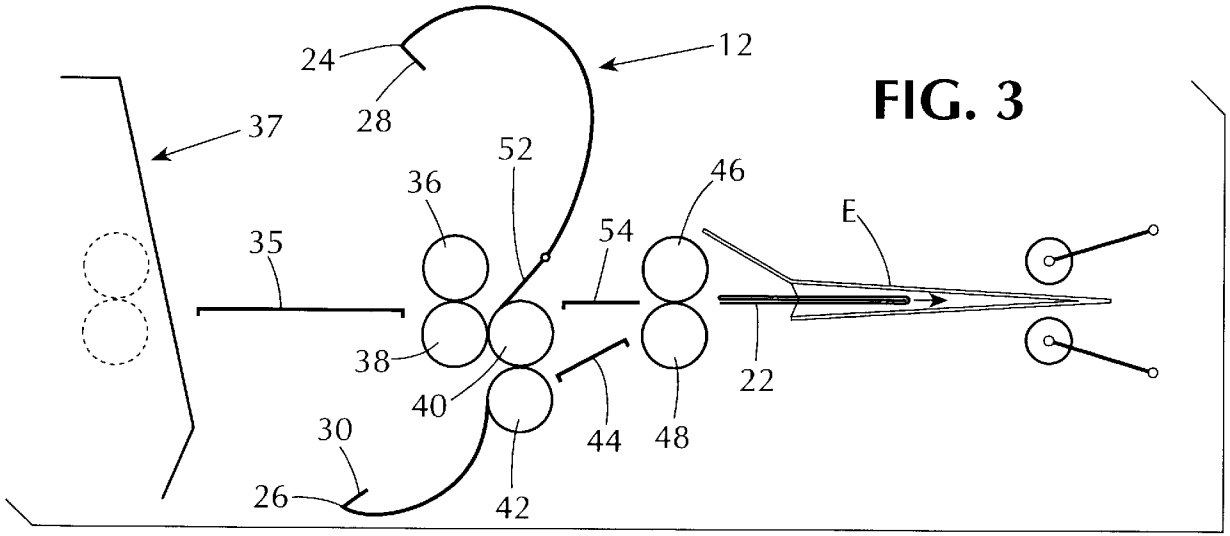
FIG. 3 is a view similar to FIG. 2 showing the folded sheet entering an envelope in a downstream envelope inserting machine.

Referring now to the drawings, and particularly to FIGS. 1 through 3 thereof, the present invention is shown and described as an improvement in a folding machine, designated generally by the reference numeral 10, which it is primarily intended for use. The folding machine 10 is shown in diagrammatic form since the specific form of construction of the folding machine is not critical to the implementation and operation of the bypass gate improvement of the present invention, and therefore is neither shown nor described in detail beyond that which is necessary for a full and complete understanding of the present invention.

As is well known in the folding machine art, a typical folding machine includes at least one but preferably a pair of buckle chutes, which, depending on the degree of complexity of the folding machine, may be either a single curved plate, or a pair of straight parallel plates, against which or between, as the case may be, a sheet can be fed until it reaches an adjustable stop at the end of the buckle chute. Since the sheet is typically longer than the distance from the entrance location of the buckle chute to the stop, the sheet forms a buckle or fold adjacent the entrance to the buckle chute. The folding machine also includes a set of cooperating feeding and folding rollers disposed adjacent the entrance to each buckle chute, the rollers serving to feed the sheet into the buckle chute and then form a crease in the sheet at the point where the sheet buckles when the leading edge thereof abuts the stop in the buckle chute. Typically, one of the rollers of the set that performs a feeding function when the sheet is being fed into the buckle chutes also cooperates with a third roller to perform the creasing function as the sheet is withdrawn from the buckle chute.

With the foregoing as background, the folding machine 10 shown in the drawings for illustrative purposes is of the type having single element upper and lower buckle chutes, designated generally by the reference numerals 12 and 14 respectively. Each buckle chute 12 and 14 has an entrance location or end 16 and 18 respectively into which the leading edge 20 of a sheet 22 is directed, typically by the entrance location or end 16 and 18 to the buckle chutes 12 and 14 lying in the natural path of the sheet as it passes through the first adjacent a pair of feeding rollers, although this is not the case with the bypass gate mechanism of the present invention, as further described below. The buckle chutes 12 and 14 are curved in a concave direction relative to the direction of feed of the sheet 22 into the buckle chutes 12 and 14 so that the sheet 22 will lie flat against the interior or adjacent surfaces of the buckle chutes 12 and 14. The buckle chutes 12 and 14 each have a closed end 24 and 26 respectively, which is defined merely by end portions 28 and 30 of the buckle chutes 12 and 14 being bent over at an acute angle so that the sheet cannot pass beyond the ends 24 and 26. In the relatively simplified form of buckle chute shown, an adjustable stop mechanism is not employed, and each buckle chute 12 and 14 imparts a fold having a fixed width, which is controlled simply by the length of the buckle chutes 12 and 14 between the entrance locations 16 and 18 and the ends 24 and 26 thereof. It will be noticed that the upper buckle chute 12, with the width of the bypass gate 52 (further described below) is considerably longer than the lower buckle chute 14, since it is necessary to feed more of the sheet 22 into this buckle chute before making the first fold.

The folding machine 10 also includes first and second sets of feeding and folding rollers, designated generally by the reference numerals 32 and 34 respectively, the first set 32 being mounted in the folding machine 10 adjacent the entrance location 16 of the upper buckle chute 12 and the second set being mounted adjacent the entrance location 18 of the lower buckle chute 12. The first set 32 of rollers comprises an upper roller 36 and a lower roller 38, and these are merely feed rollers for the sheet 22 which receive the sheet from a suitable conveying mechanism indicated by the guide plate 35 which may be part of the exit end of an upstream processing machine, such as the laser printer discussed above and designated generally by the reference numeral 37 (FIG. 2). The second set 34 of rollers comprise and upper roller 40 and a lower roller 42, and these rollers function both as folding rollers to impart a crease to the buckle formed in the sheet when it is fed into the lower buckle chute 14, and as feeding rollers to feed the folded sheet across a suitable guide plate 44 to another pair of feeding rollers 46 and 48 which represent the entrance into an inserting machine, designated generally by the reference numeral 50, to which further reference is made below. The roller 38 of the first set 32 and the roller 40 of the second set 34 function as both folding rollers to impart a crease to the buckle formed in the sheet when it is fed into the upper buckle chute 12, and as feeding rollers to feed the partly folded sheet into the lower buckle chute 14 for further folding. This sequence of operation will be further described below in connection with the description of operation of the folding machine.

As briefly indicated above, in a typical folding machine, the entrance location of the buckle chutes are positioned closely adjacent to the nip of the sets of feeding and folding rollers associated with each buckle chute. In a folding machine incorporating the envelope bypass gate mechanism of the present invention, however, the entrance location 16 of the upper buckle chute 12 is spaced away from the nip of the feed rollers 36 and 38 to provide room for a movable bypass gate 52 which is pivotally mounted in the folding machine for limited movement between a lower position shown in FIG. 2 and an upper position shown in dotted lines in FIG. 1 and in solid lines in FIG. 4. Referring firstly to FIG. 2, when the bypass gate 52 is in the lower position, the lead edge 20 of an incoming sheet 22 engages 20 the upper surface of the bypass gate 52 and is directed along the interior surface of the upper buckle chute 12. However, when the bypass gate 52 is in the upper position, the lead edge of an envelope E is not directed into the upper buckle chute 12, but rather is directed straight through the feeding rollers 36 and 38, over the upper roller 40 of the second set 34 of rollers, across a suitable guide plate 54 and into the feeding rollers 46 and 48, which represent the entrance into the envelope inserting machine 50. Thus, when the bypass gate 52 is in the upper position, the guide plate 35, feed rollers 36 and 38 and guide plate 54 constitute a means defining a main path of travel for envelopes passing through the folding machine 10 which bypasses the entrance locations 16 and 18 of the buckle chutes 12 and 14, also as further explained below in connection with the description of operation of the folding machine 10.

The bypass gate 52 is moved from one position to the other by movement of an envelope past a predetermined location in the folding machine 10, at which location a portion of the envelope functions as an actuator on an intervening mechanism which in turn moves the bypass gate 52 from the lower position in which it causes sheets to enter the buckle chutes to the upper position in which it permits envelopes to remain in the main path of travel. In one embodiment of the invention, the bypass gate 52 is moved between the lower and upper positions by a solenoid assembly, designated generally by the numeral 53, suitably mounted in the folding machine 10, the solenoid assembly 53 having a housing 56 containing a coil which, when energized, moves an armature 58 downwardly against a compression spring 60. The lower end of the armature 58 is pivotally connected to one end of a link 62, the other end of which is rigidly connected to a tab 64 which is part of the bypass gate 52. Thus, it will be seen that when the solenoid is energized and the armature 58 moves downwardly, the bypass gate 52 is pivoted from the solid line position in FIG. 2 to the dotted line position, and when the solenoid is deenergized, the spring 60 returns the armature 58 to the raised position which pivots the bypass gate 52 back to the solid line position.

Figure 4:
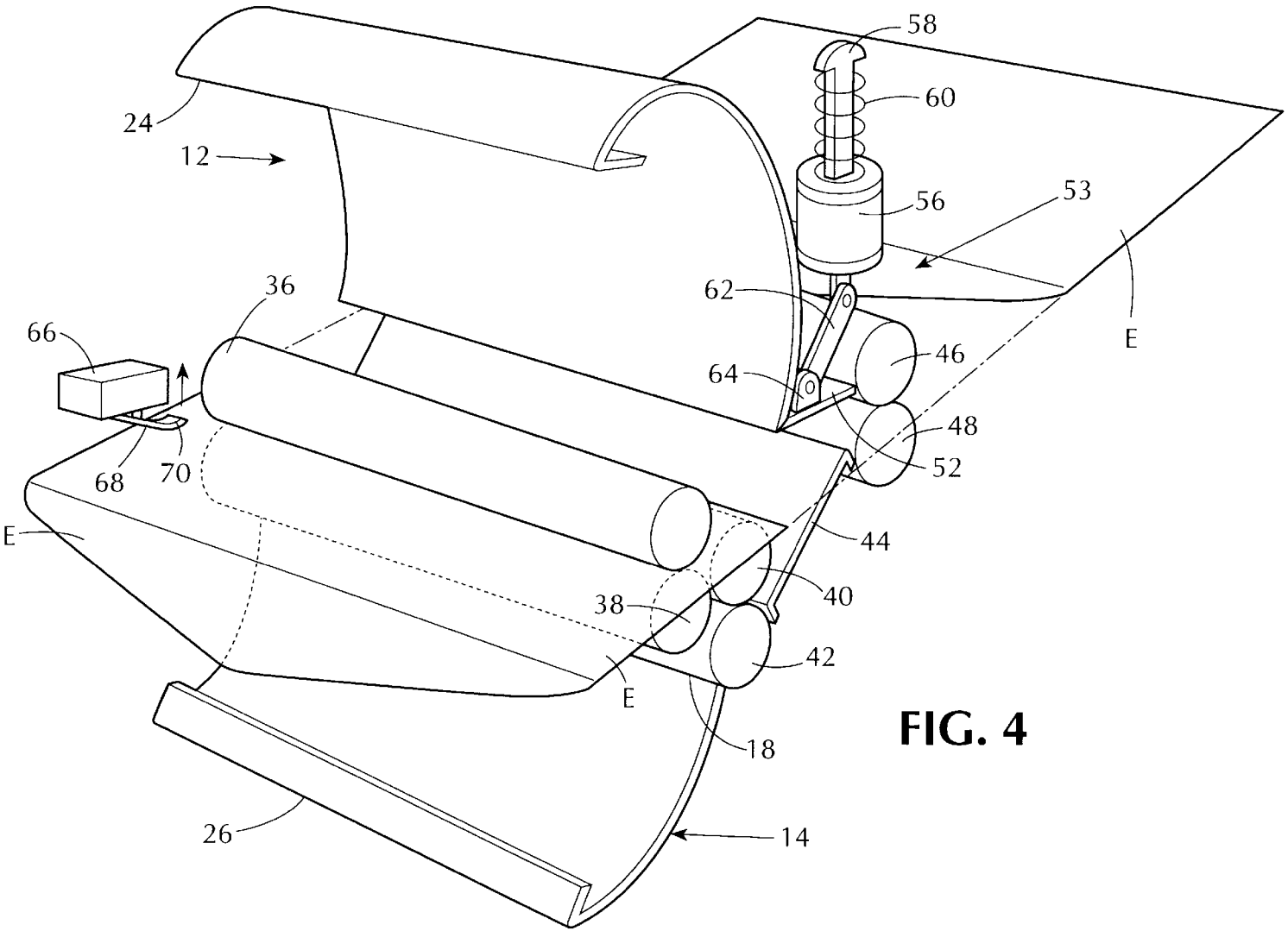
FIG. 4 is a view similar to FIG. 1 showing an envelope entering the folding machine but bypassing the folding mechanism thereof and being directed straight through the folding machine to the inserting machine.

The solenoid is actuated by a micro switch 66 suitably mounted in the folding machine 10 at the designated predetermined location, the microswitch 66 having an actuating arm 68 which includes an end portion 70 which is disposed adjacent the edge of the main path of travel of the sheets 22 but slightly beyond the lateral edge 23 thereof so that the sheet 22 does not touch the end portion 70 of the actuating arm 68 and therefore does not actuate the switch 66 to energize the solenoid. However, since the envelopes E are slightly longer than the width of the sheet 22, as best seen by the comparison in FIG. 7, a marginal portion of an envelope E will contact the end portion 70 of the actuating arm 68, as seen in FIG. 4, to thereby energize the solenoid and raise the bypass gate 52 to the upper position. This operation is further described below in conjunction with the description of operation of the folding machine 10.

Figure 5:
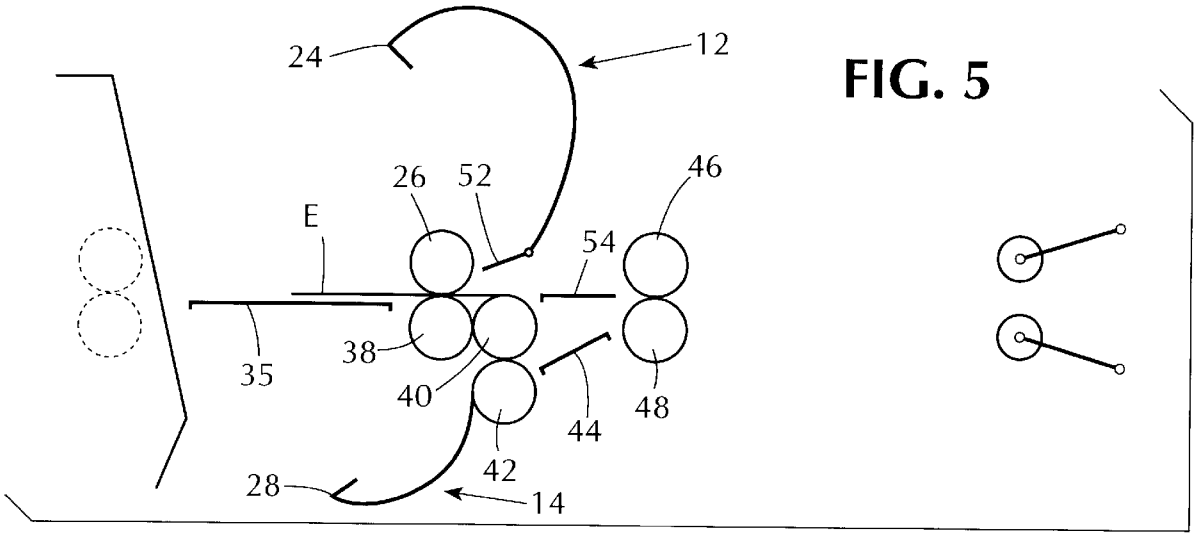
FIGS. 5 and 6 are views similar to FIGS. 2 and 3, but showing an envelope entering the folding machine with the envelope bypass gate in the non-diverting position to cause the envelope to be fed therethrough directly to the inserting machine.
Figure 6:
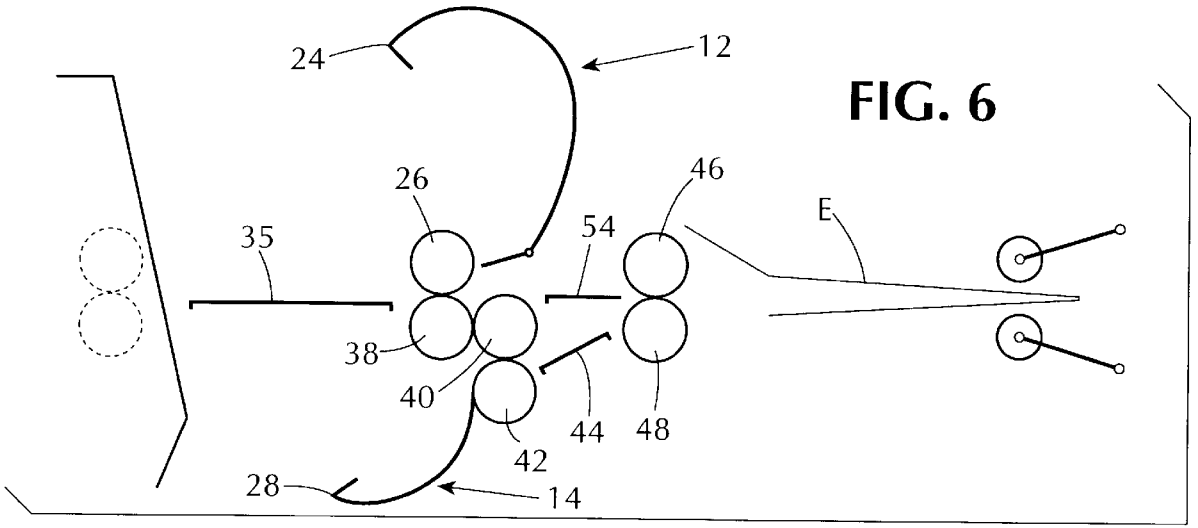

In an alternate form of the invention, the bypass gate 52 is not moved by a solenoid, but rather is self actuated directly by the envelopes as they pass the predetermined location. Thus, with reference to FIGS. 5 through 8, the bypasss gate 52' is again pivotally mounted in the folding machine by a pair of links 72 rigidly connected to the bypass gate 52' and pivotally mounted on a shaft 74. A pair of actuating fingers, designated generally by the reference numeral 76, are disposed in the main path of travel in overlying relationship to the rollers 38 and 40 and in the marginal portion thereof beyond the limits of the width of a sheet 22, as best seen in FIG. 5, so that the sheet 22 can pass between the actuating fingers 76 without making contact therewith.

Figure 7:
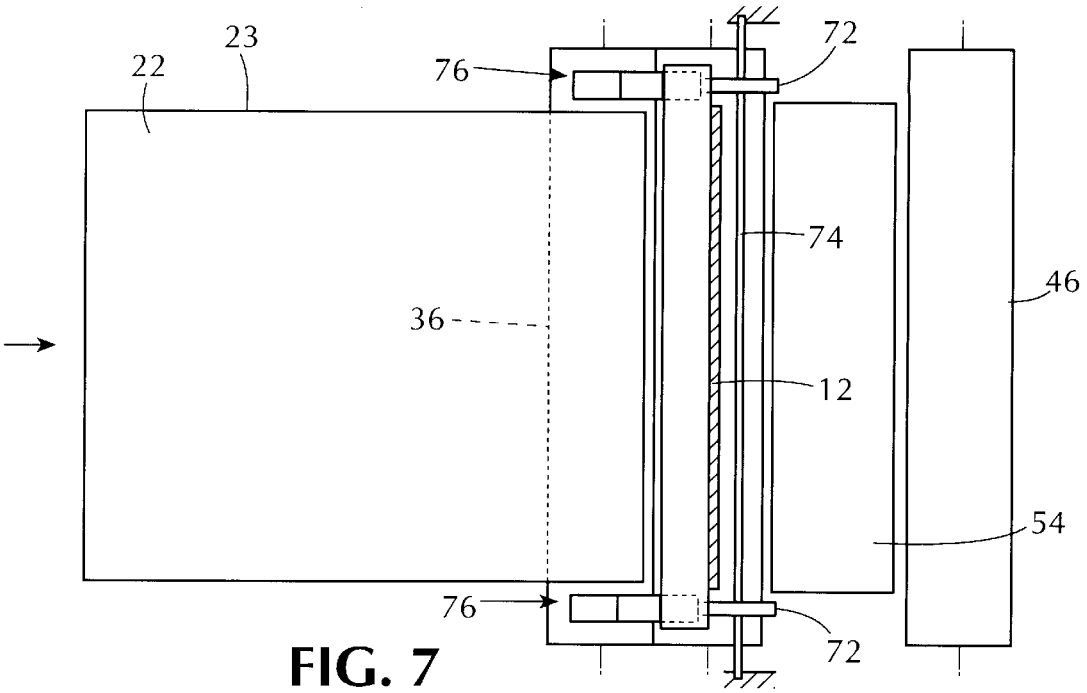
FIG. 7 is a plan view of an alternate form of the actuating portion of the bypass gate with a sheet passing therethrough.
Figure 9:
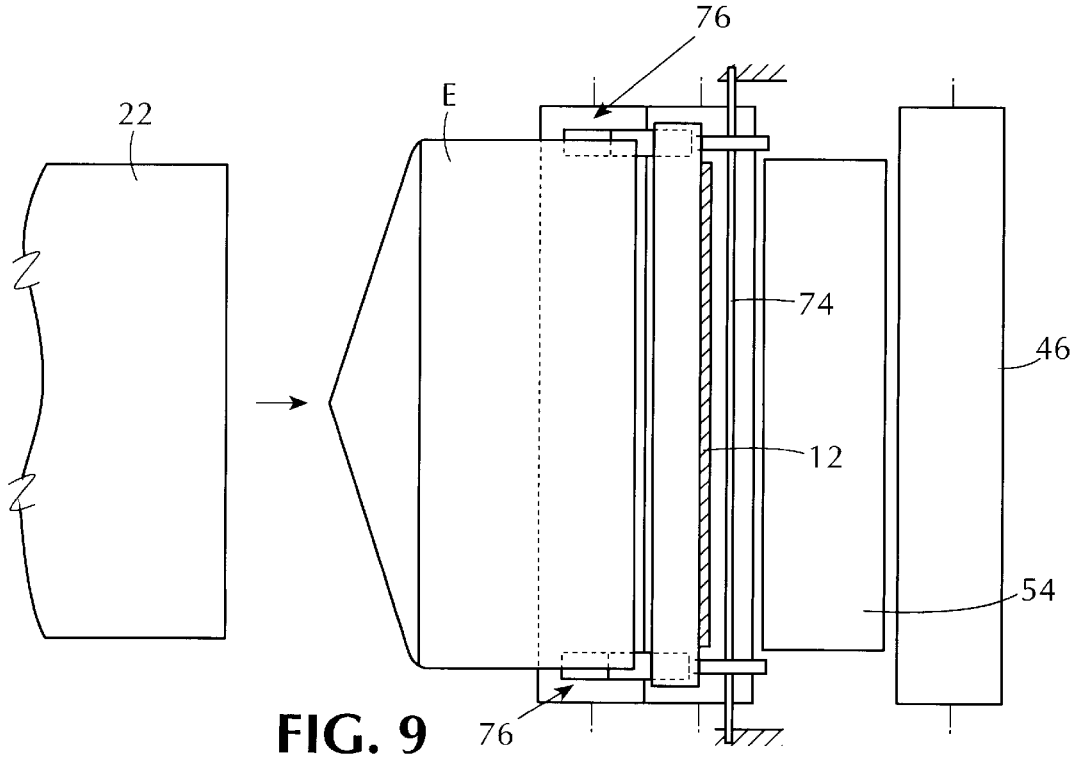
FIG. 9 is a view similar to FIG. 7 but showing an envelope passing through the folding machine.
Figure 10:
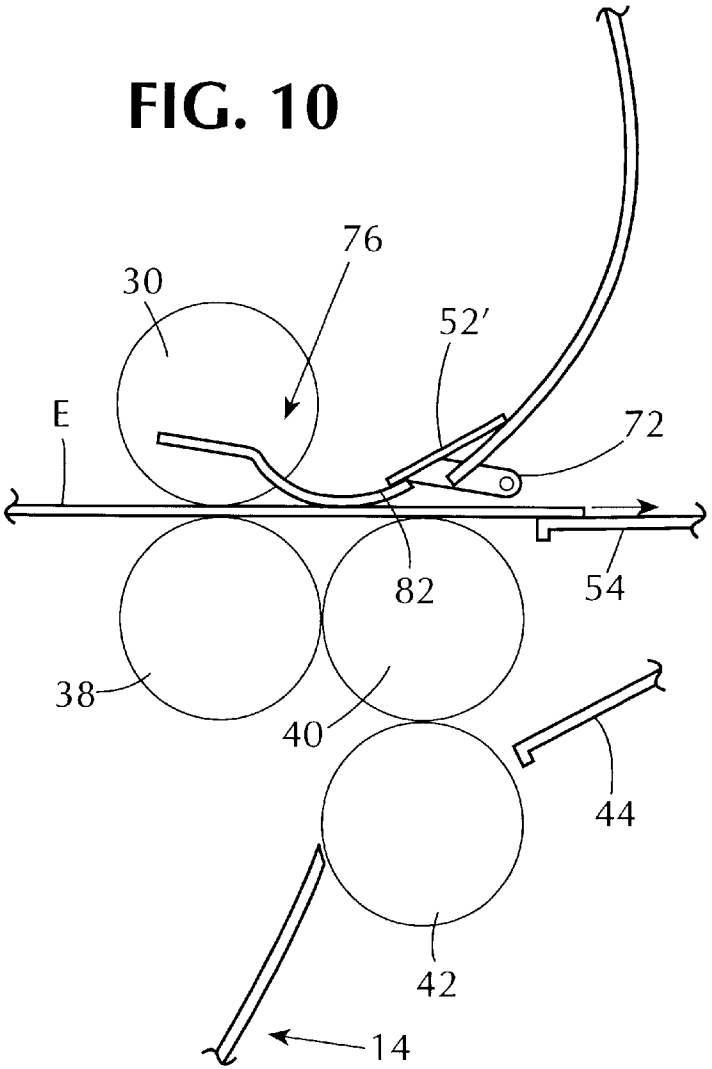
FIG. 10 is a view similar to FIG. 8 but with the bypass gate in the non-diverting position and directing an envelope straight through the folding machine.
Figure 8:
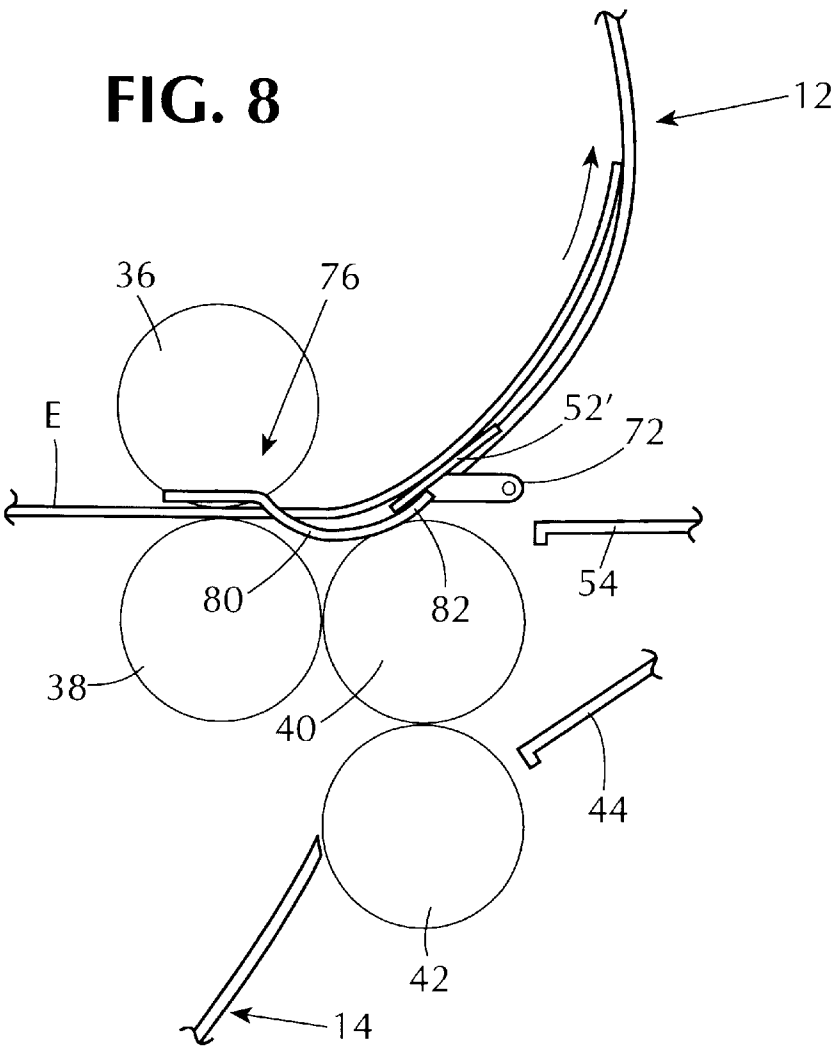
FIG. 8 is a side view of the alternate form of the bypass gate showing the bypass gate in the diverting position and directing a sheet into the folding mechanism.

As best seen in FIG. 7, the actuating fingers 76 are disposed such that they are within the limits of the side edges of an envelope E. Each actuating finger 76 comprises a flat portion 78 on the upstream end of the actuating finger 76 which is configured to lie just slightly above the plane of the main path of travel of sheets and envelopes passing between the rollers 36 and 38. Just beyond the nip of the rollers 36 and 38, the flat portion 78 merges with a curved portion 80 which is depressed beneath the plane of the main path of travel, so that the lead edge of the envelope E engages the lower curved surface of the curved portion 80. The other end of the curved portion 80 is suitably rigidly connected to the bypass gate 52', as indicated at 82, with the result that when the lead edge of an envelope E engages the lower surface of the curved portion 80, the entire actuating finger 76 is raised a sufficient distance to permit the envelope to pass beneath the bypass gate 52' so that the envelope E continues to follow the main path of travel through the folding machine 10 directly to the inserting machine 50 as described above.

The operation of the folding machine 10 will now be described. In a typical application in which a plurality of envelopes are printed with the name and address of a series of addressees, and a corresponding number of pre-printed letters are customized by having the name and address of the same series of addressees printed on the letters, and assuming that there is no envelope at the start of the run in position to receive a letter in the envelope inserting machine 50, the laser printer 37 first prints a name and address on an envelope and then prints the same name and address on the form letter to customize the letter to that addressee. The laser printer 37 feeds the envelope to the conveyor 35 which in turn feeds it into the first set of feed rollers 32. As soon as the envelope reaches the predetermined location of either the microswitch 66 or the actuating arm 76, in the first embodiment of the invention, the lead edge of the marginal portion of the envelope E engages either the portion 70 of the actuating arm 68 to close the microswitch 66, thereby energizing the solenoid to depress the armature 60 and move the bypass gate from the lower position shown in FIGS. 1 through 3 to the upper position shown in FIGS. 4 through 6, thereby permitting the envelope E to remain in the main path of travel and move into the inserting machine 50, as indicated by the envelope E in FIG. 6. In the alternate embodiment, the lead edge of the marginal portion of the envelope E engages the lower surface of the curved portion 80 of the actuating finger 76, thereby raising the bypass gate as just described, again to permit the envelope to follow the main path of travel directly to the inserting machine. As soon as the trailing edge of the envelope E passes either the microswitch 66 or the actuating finger 76, as the case may be, the solenoid is deenergized and the spring 60 returns the bypass gate to the original position. In the alternate embodiment, the weight of the bypass gate 52 and the actuating fingers 76 are sufficient to cause the bypass gate to return to the original position. Optionally, a spring could also be utilized to ensure that the bypass gate 52 returns to its original position.

After the laser printer 37 completes the name and address printing on the envelope, it then prints the same information on the letter and feeds the letter to the conveyor 35. It should be noted that if the letter consists of more than one page, it is customary to provide some type of accumulating device for the pages of the letter so that all pages are fed into the folding machine simultaneously for folding together. The conveyor 35 then feeds the letter into the first set of feed rollers 36 and 38, but since the width of the sheets on which the letter is printed does not reach the contact portion 70 of the actuating arm 68 for the microswitch 66, and is less than the distance between the actuating arms 76 of the alternate embodiment, the bypass gate 52 is not moved from the position shown in FIGS. 1 through 3, with the result that the sheets are directed out of the main path of travel by the bypass gate 52 and into the upper buckle chute 12 where the first buckle is formed between the rollers 38 and 40. These rollers then impart a crease to the first buckle and then feed the partly folded sheet or sheets into the lower buckle chute 14 where the second buckle is formed between the rollers 40 and 42. These rollers then impart a crease to the second buckle and feed the fully folded sheet or sheets into along the guide 44 to the rollers 46 and 48, which as mentioned before, indicate the entrance to the envelope inserting machine 50, where the sheet or sheets are inserted into the envelope, as seen in FIG. 3. The filled envelope E is then ejected from the envelope inserting machine 50 to make room for the next envelope.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto. It should be further understood that the principles of the present invention are not to be limited strictly to the application of a folding machine, it being deemed that these principles are applicable to other applications in which sheets and envelopes are fed into a sheet processing machine in which the sheets and envelopes are separately processed and therefore must be directed along different paths of travel within the processing machine before ultimately being directed out of the processing machine.

We claim:

1. In a folding machine for folding sheets of paper preparatory to the sheets being inserted into envelopes in an envelope inserting machine, and for feeding envelopes through the folding machine to the envelope inserting machine, the envelopes having at least one longitudinal marginal portion which extends beyond the width of the sheets, the folding machine having first and second buckle chutes each having an entrance location adjacent one another for receiving sheets to be folded, and first and second sets of feeding and folding rollers disposed adjacent said entrance locations of said buckle chutes for folding sheets directed into said buckle chutes, the improvement in said folding machine comprising A. means defining a main path of travel for envelopes through said folding machine which bypasses said entrance locations into said buckle chutes, B. gate means mounted in said folding machine adjacent said entrance opening of said first buckle chute, C. means mounting said gate means for movement between a first position in which said gate means diverts sheets from said main path of travel and into said first buckle chute for folding, to a second position in which said gate means permits envelopes to follow said main path of travel through said folding machine to said inserting machine, wherein means for moving said gate means from said first position to said second position comprises a pair of actuating fingers operatively connected to said gate means for moving said gate means and disposed in said main path of travel upstream from said entrance openings into said buckle chutes beyond the lateral margins of said sheets within the longitudinal margin of said envelopes so as to be engaged by the lateral marginal portions and longitudinal marginal portions of said envelopes which extend beyond said lateral margins of said sheets as said envelopes move through said main path of travel, D. means responsive to an envelope arriving at a predetermined location in said folding machine for moving said gate means from said first position to said second position, and E. means responsive to said envelope passing said predetermined location for moving said gate means from said second position back to said first position, whereby sheets entering said folding machine are diverted from said main path of travel and are folded by said buckle chutes and said feeding and folding rollers, and envelopes entering said folding machine are permitted to follow said main path of travel through said folding machine directly to said inserting machine and bypass said buckle chutes.

2. In a folding machine for folding sheets of paper preparatory to the sheets being inserted into envelopes in an envelope inserting machine, and for feeding envelopes through the folding machine to the envelope inserting machine, the envelopes having at least one longitudinal marginal portion which extends beyond the width of the sheets, the folding machine having first and second buckle chutes each having an entrance location adjacent one another for receiving sheets to be folded, and first and second sets of feeding and folding rollers disposed adjacent said entrance locations of said buckle chutes for folding sheets directed into said buckle chutes, the improvement in said folding machine comprising A. means defining a main path of travel for envelopes through said folding machine which bypasses said entrance locations into said buckle chutes, B. gate means mounted in said folding machine adjacent said entrance opening of said first buckle chute, C. means mounting said gate means for movement between a first position in which said gate means diverts sheets from said main path of travel and into said first buckle chute for folding, to a second position in which said gate means permits envelopes to follow said main path of travel through said folding machine to said inserting machine, wherein said means for moving said gate means from said first position to said second position comprises a solenoid operatively connected to said gate means for moving said gate means from said first position to said second position when said solenoid is energized, and means disposed in said main path of travel in position to be engaged by said one marginal portion of said envelope comprises switch means adapted when engaged by said marginal portion of said envelopes to energize said solenoid;

D. means responsive to an envelope arriving at a predetermined location in said folding machine for moving said gate means from said first position to said second position, and E. means responsive to said envelope passing said predetermined location for moving said gate means from said second position back to said first position, whereby sheets entering said folding machine are diverted from said main path of travel and are folded by said buckle chutes and said feeding and folding rollers, and envelopes entering said folding machine are permitted to follow said main path of travel through said folding machine directly to said inserting machine and bypass said buckle chutes.

3. The improvement as set forth in claim 2 wherein said means for moving said gate means from said second position back to said first position comprises resilient means for returning said gate means to said first position when said marginal portion of said envelope has passed said switch means and deenergized said solenoid.

4. The improvement as set forth in claim 2 wherein means operatively connected to said gate means comprises a tab operatively connected to said gate means and disposed in said main path of travel beyond the lateral margin of said sheets but within the longitudinal margins of said envelopes so as to be engaged by said one marginal portion of said envelopes as said envelopes move through said main path of travel.

5. The improvement set forth in claim 1 where said actuating fingers comprise an elongate member having one end thereof connected to said gate means and extending along said main path of travel in a direction opposite to the direction of feed of said envelopes and said sheets, said actuating finger having a first upstream portion disposed slightly above the plane of said main path of travel and a second downstream portion connected to said upstream portion that extends below the plane of said main path of travel, whereby the lead edge of the marginal portion of an envelope engages the under surface of said second downstream portion to raise said actuating finger and thereby raise said gate means to said second position to permit said envelope to pass thereunder in said main path of travel.

* * * * *